US007507445B2

(12) United States Patent
Su

(10) Patent No.: US 7,507,445 B2
(45) Date of Patent: Mar. 24, 2009

(54) METHOD FOR MAKING A GRIP OF A GOLF CLUB

(75) Inventor: Bifang Su, Yi Jung Town (CN)

(73) Assignee: Feeltecgrip Inc., Changhua County (TW)

( * ) Notice: Subject to any disclaimer, the term of this patent is extended or adjusted under 35 U.S.C. 154(b) by 204 days.

(21) Appl. No.: 11/160,077

(22) Filed: Jun. 8, 2005

(65) Prior Publication Data

US 2005/0276925 A1 Dec. 15, 2005

(30) Foreign Application Priority Data

Jun. 15, 2004 (CN) ..... 2004 1 0155133

(51) Int. Cl.
*B05D 1/00* (2006.01)
*B05D 1/02* (2006.01)
*B05D 1/18* (2006.01)
*B05D 1/38* (2006.01)

(52) U.S. Cl. ..... 427/407.1; 427/384; 427/427.4; 427/430.1

(58) Field of Classification Search ..... None
See application file for complete search history.

(56) References Cited

U.S. PATENT DOCUMENTS

| | | | | | |
|---|---|---|---|---|---|
| 2,981,631 | A * | 4/1961 | Nagel | 427/185 |
| 3,443,984 | A * | 5/1969 | Sherman | 427/373 |
| 4,241,115 | A * | 12/1980 | Temin | 428/336 |
| 5,571,050 | A * | 11/1996 | Huang | 473/300 |
| 5,816,963 | A * | 10/1998 | Brooks et al. | 473/564 |
| 2004/0082413 | A1 * | 4/2004 | Leal et al. | 473/564 |

FOREIGN PATENT DOCUMENTS

| | | | |
|---|---|---|---|
| CA | 2116707 | A1 * | 9/1995 |
| GB | 1167046 | * | 10/1969 |
| JP | 07-59618 | A * | 3/1995 |

* cited by examiner

*Primary Examiner*—William Phillip Fletcher, III
(74) *Attorney, Agent, or Firm*—Alan Kamrath; Kamrath & Associates PA

(57) ABSTRACT

A method is disclosed for making a grip. The method includes the step of providing a tube and the step of coating the tube with polyurethane resin in order to provide a cushion on the tube. The step of coating the cushion with the polyurethane resin includes the step of providing the polyurethane resin in a wet process. The method includes the step of curing the polyurethane resin on the tube after the step of coating the tube with the polyurethane resin. The method includes the step of drying the polyurethane resin cured on the tube the step of curing the polyurethane resin on the tube.

32 Claims, 7 Drawing Sheets

METHOD FOR MAKING A GRIP OF A GOLF CLUB

BACKGROUND OF INVENTION

1. Field of Invention

The present invention relates to a method for making a grip and, more particularly, to a method for making a grip of a golf club.

2. Related Prior Art

A grip of a golf club generally includes a rubber or thermoplastic tube provided on a golf club and a cushion provided on the rubber or thermoplastic tube in order to protect a golfer's arms from impacts that occur when he or she hits a golf ball with the golf club. Conventionally, to provide the cushion on the rubber or thermoplastic, the cushion is made as a strip, and the strip is wound on the rubber or thermoplastic tube manually. In using this conventional method, at least one problem is encountered. The manual winding is complicated and the efficiency thereof is low. In using the grip made by this conventional method, at least one problem is encountered. Because the strip is wound on the rubber or thermoplastic tube, the strip will inevitably be stripped from the rubber or thermoplastic tube after the golf club is used for some time. In that case, there will be no cushion at all.

The present invention is therefore intended to obviate or at least alleviate the problems encountered in prior art.

SUMMARY OF INVENTION

According to the present invention, a method for making a grip includes the step of providing a tube and the step of coating the tube with polyurethane resin in order to provide a cushion on the tube.

An advantage of the method of the present invention is that the cushion is firmly provided on the tube.

Another advantage of the method of the present invention is that the grip is made in an efficient and inexpensive manner.

Other advantages and novel features of the invention will become more apparent from the following detailed description in conjunction with the attached drawings.

BRIEF DESCRIPTION OF DRAWINGS

The present invention will be described via detailed illustration of embodiments referring to the drawings.

DETAILED DESCRIPTION OF EMBODIMENTS

Figure 1:
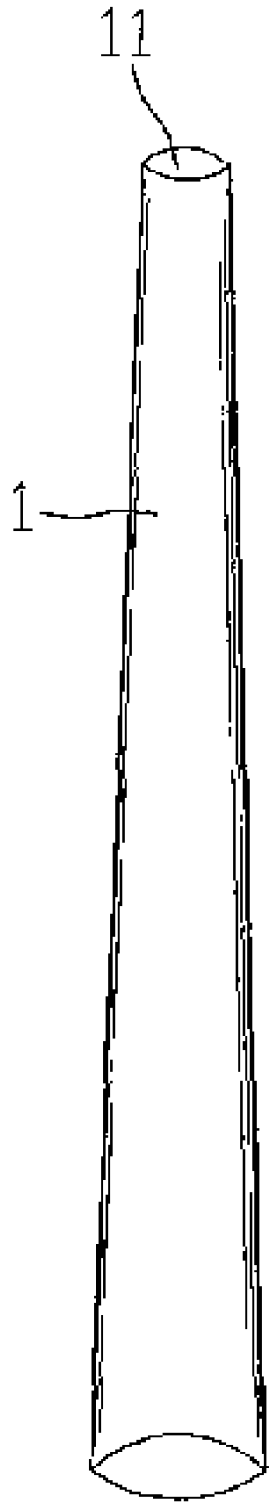
FIG. 1 is a perspective view of a rubber or thermoplastic tube from which a grip is made by a method according to the present invention.

FIG. 1 shows a tube 1 that can be coated with resin in order to become a grip according to the present invention. The tube 1 may be made of rubber, thermoplastic, a foam material or any other proper material. The thermoplastic material may be thermoplastic polyurethane or thermoplastic polyolefin. The rubber is synthesized rubber such as ethylene-propylene rubber, butyl rubber, butyronitrile rubber, chloroprene rubber and butadiene rubber. The tube 1 includes a thick closed end and a thin open end 11 into which a golf club can be inserted.

Figure 2:
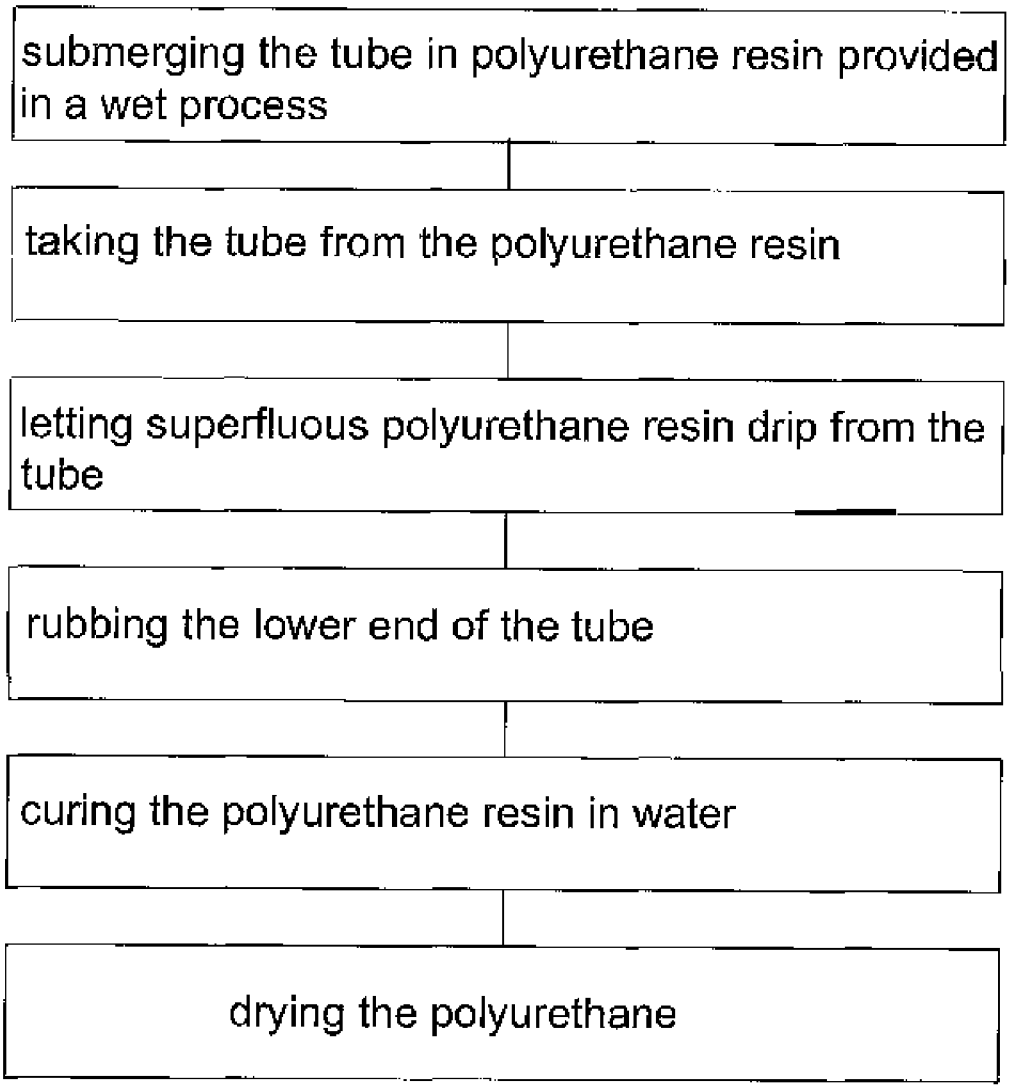
FIG. 2 is a flow chart of a method for making a grip from the rubber or thermoplastic tube shown in FIG. 1 according to a first embodiment of the present invention.

Referring to FIG. 2, there is shown a method for making a grip from the tube 1 according to a first embodiment of the present invention. In the first embodiment, the tube 1 is made of a foam material.

At the first step, a large portion of the tube 1 is vertically submerged in a pool of polyurethane resin in a wet process. A small portion of the tube 1 is kept removed from the polyurethane resin. The length of the small portion of the tube 1 is about 1 to 3 millimeters measured from the thin open end 11. The viscosity of the polyurethane resin is about 1000 to 200000 cps/25° C.

It is preferred to submerge the tube 1 in the polyurethane resin from the thick closed end and keep the small portion removed from the polyurethane resin. However, the tube 1 can be submerged in the polyurethane resin from the thin open end, and the whole tube 1 can be submerged in the polyurethane resin as long as the interior of the tube 1 is kept removed from the polyurethane resin.

The polyurethane resin is high polymer. In the wet process, the polyurethane resin is dissolved in a solvent such as DMF. DMF can be dissolved in water. As the polyurethane resin is put in the water, the DMF is replaced with the water. The polyurethane resin eventually cures and becomes a porous film absorbing impacts and sweat. The resultant grip according to the present invention provides a soft and comfortable feel to a user. The resultant grip provides a higher frictional coefficient so that it can be gripped firmly by the user.

Second, the tube 1 is moved from the pool of polyurethane resin soon after it is coated with the polyurethane resin.

Third, the tube 1 is held vertically. Thus, superfluous polyurethane resin drips from the tube 1. The time for dripping is about 30 seconds to 10 minutes. The relative humidity is controlled to be less than 70% in order to avoid the polyurethane resin from absorbing the humidity. Such absorption would cause the polyurethane resin to become white and affect the appearance of the resultant cushion.

Fourth, the thick closed end of the tube 1 is rubbed on a web. Thus, a small amount of the polyurethane resin dripping from the thick closed end of the tube 1 is wiped away. The web is made of stainless steel, and its density is about 10 to 100 eye/inch. The relative humidity is controlled to be less than 70%.

Fifth, the tube 1 coated with the polyurethane resin is put in a curing device such as a tank filled with water. The solvent is released to the water from the polyurethane resin. Thus, the polyurethane resin cures on the surface of the tube 1. The temperature of the water in the tank is 20° C. to 90° C. Time for curing is longer than 30 minutes.

Sixth, the polyurethane resin is dried and becomes a cushion on the tube 1. Finally, a grip is made for a golf club. The temperature is 20° C. to 90° C. Time for drying is longer than 5 minutes. The drying can take place in an oven or any other drying devices that can remove moisture.

Figure 3:
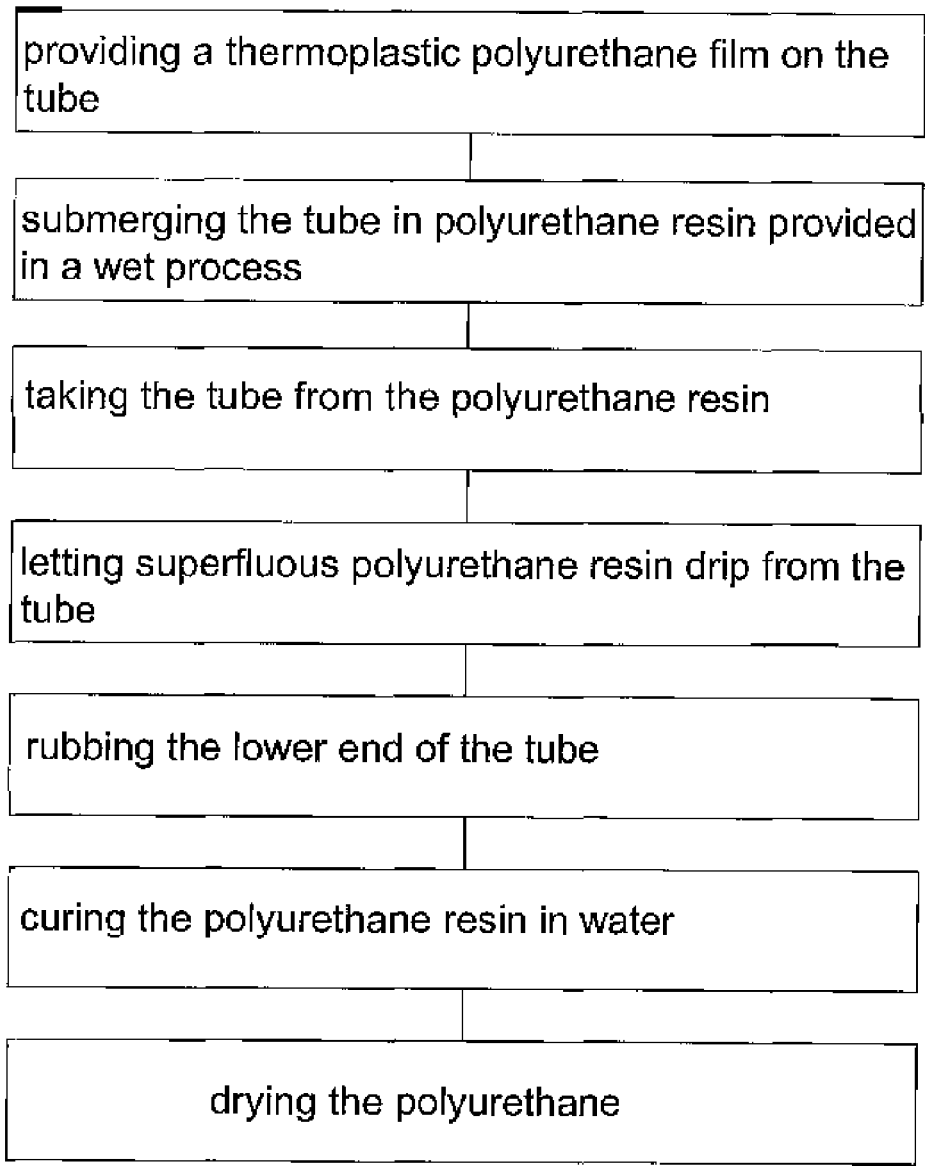
FIG. 3 is a flow chart of a method for making a grip from the rubber or thermoplastic tube shown in FIG. 1 according to a second embodiment of the present invention.

FIG. 3 is a flow chart of a method according to a second embodiment of the present invention. In the second embodiment, the tube 1 is an elastic element. The second embodiment is similar to the first embodiment except including the step of providing a thermoplastic polyurethane film on the tube 1 before the step of submerging the tube 1 in the pool of polyurethane resin.

Figure 4:
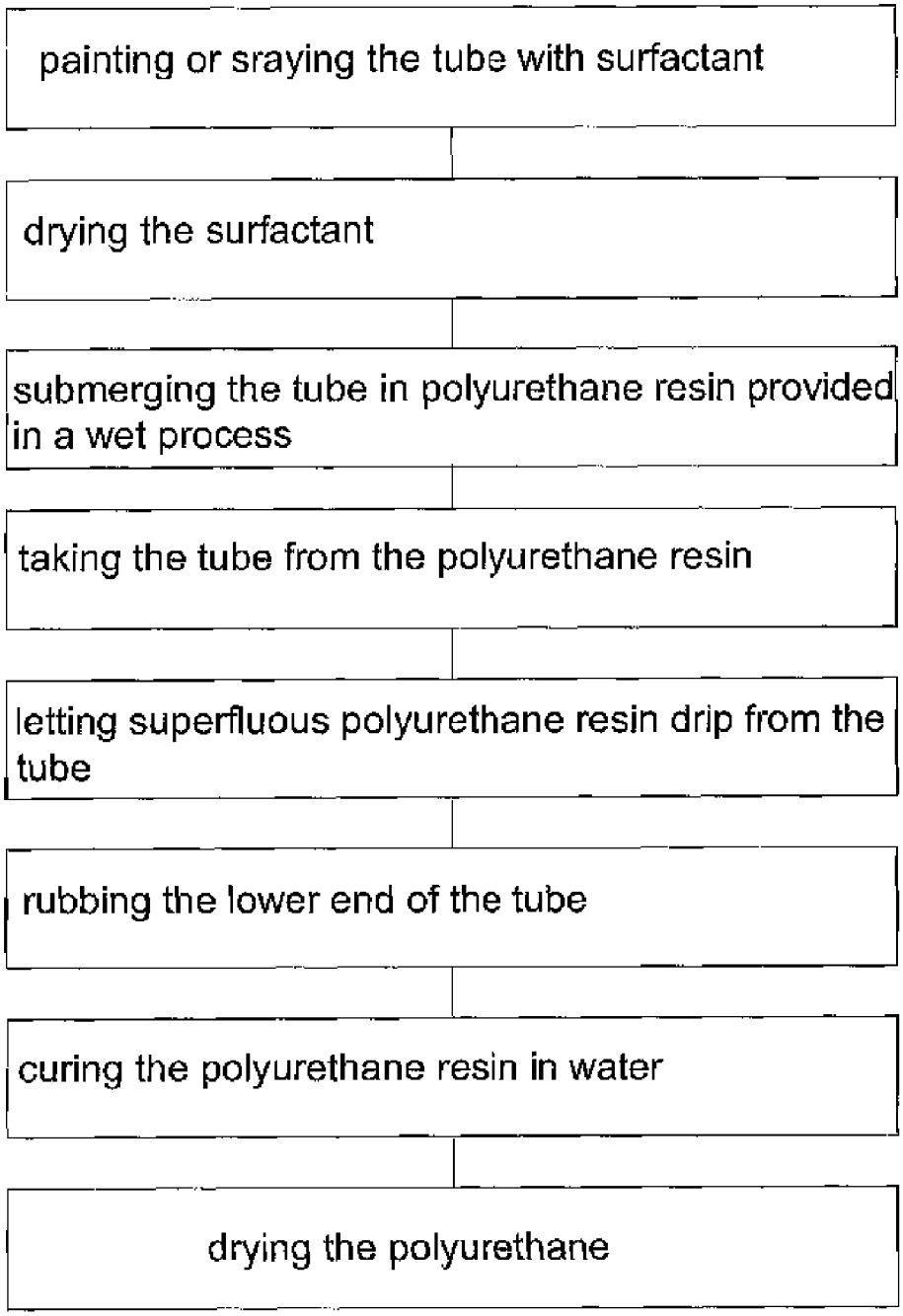
FIG. 4 is a flow chart of a method for making a grip from the rubber or thermoplastic tube shown in FIG. 1 according to a third embodiment of the present invention.

FIG. 4 is a flow chart of a method according to a third embodiment of the present invention. The third embodiment is similar to the first embodiment except including two steps before the step of submerging the tube 1 in the pool of polyurethane resin.

Firstly, by painting or spraying, surfactant is provided on a large portion of the tube 1, leaving a small portion without the surfactant. The length of the small portion of the tube 1 is about 1 to 3 millimeters measured from the thin open end 11. The surfactant is provided in order to facilitate coating the tube 1 with the polyurethane resin.

Secondly, the surfactant provided on the tube 1 is dried.

The surfactant is provided between the tube 1 and the cushion in order to increase the polarity of the tube 1. This coating of surfactant exhibits adequate moisture and affinity for the polyurethane resin so that a "bridge" is built between the tube 1 and the polyurethane resin. Thus, the cushion is adhered to the tube 1 tightly and will not be stripped from the tube 1 easily. Where the tube 1 is made of rubber, the surfactant may be a halogenating agent such as trichloroisocyanuric acid for increasing the polarity of the tube 1 and the adhesion of the polyurethane resin.

Figure 5:
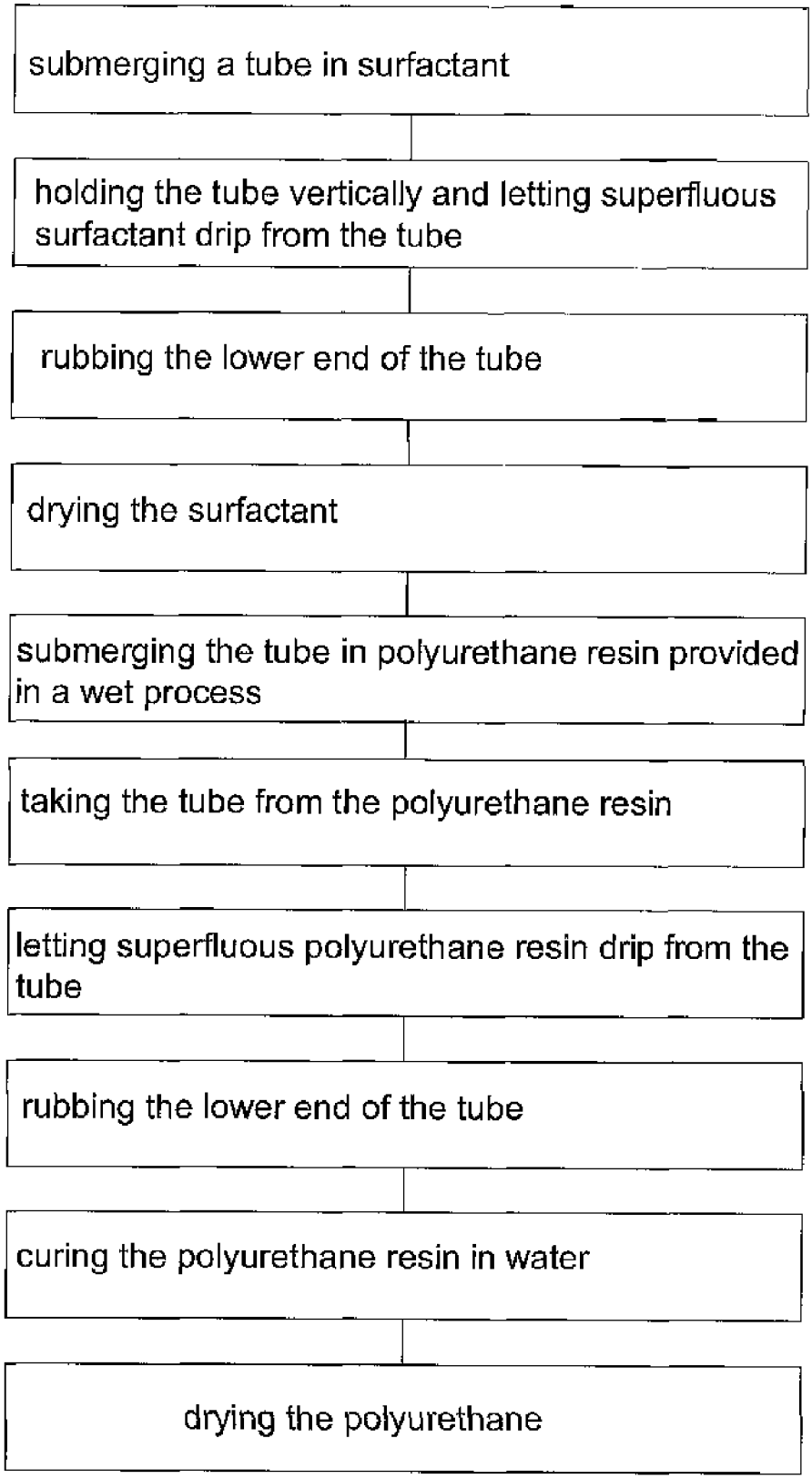
FIG. 5 is a flow chart of a method for making a grip from the rubber or thermoplastic tube shown in FIG. 1 according to a fourth embodiment of the present invention.

FIG. 5 is a flow chart of a method according to a fourth embodiment of the present invention. The fourth embodiment is similar to the first embodiment except including four steps before the step of submerging the tube 1 in the pool of polyurethane resin.

Firstly, a large portion of the tube 1 is vertically submerged in a pool of surfactant, leaving a small portion from the surfactant. The length of the small portion of the tube 1 is about 1 to 3 millimeters measured from the thin open end 11. The surfactant is provided in order to facilitate coating the tube 1 with the polyurethane resin. The tube 1 is moved from the pool of surfactant after it is coated with the surfactant.

It is preferred to submerge the tube 1 in the surfactant from the thick closed end and keep the small portion removed from the surfactant. However, the tube 1 can be submerged in the surfactant from the thin open end, and the whole tube 1 can be submerged in the surfactant as long as the interior of the tube 1 is kept removed from the surfactant.

Secondly, the tube 1 coated with the surfactant is held vertically so that superfluous surfactant drips from the tube 1. Time for dripping is controlled to be longer than 30 seconds. The relative humidity is controlled to be less than 70% so that the tube 1 does not get wet and that the surfactant cures and becomes a film without flaws. Thus, the binding of the surfactant with the polyurethane resin is excellent.

Thirdly, the thick closed end of the tube 1 is rubbed on a web. Thus, a small amount of the surfactant dripping from the thick closed end of the tube 1 is wiped away. The relative humidity is controlled to be less than 70%.

Fourthly, the tube 1 coated with the surfactant is dried at a temperature of 20° C. to 90° C. for at least 2 minutes. Thus, the surfactant on the tube 1 is completely dried.

Figure 6:
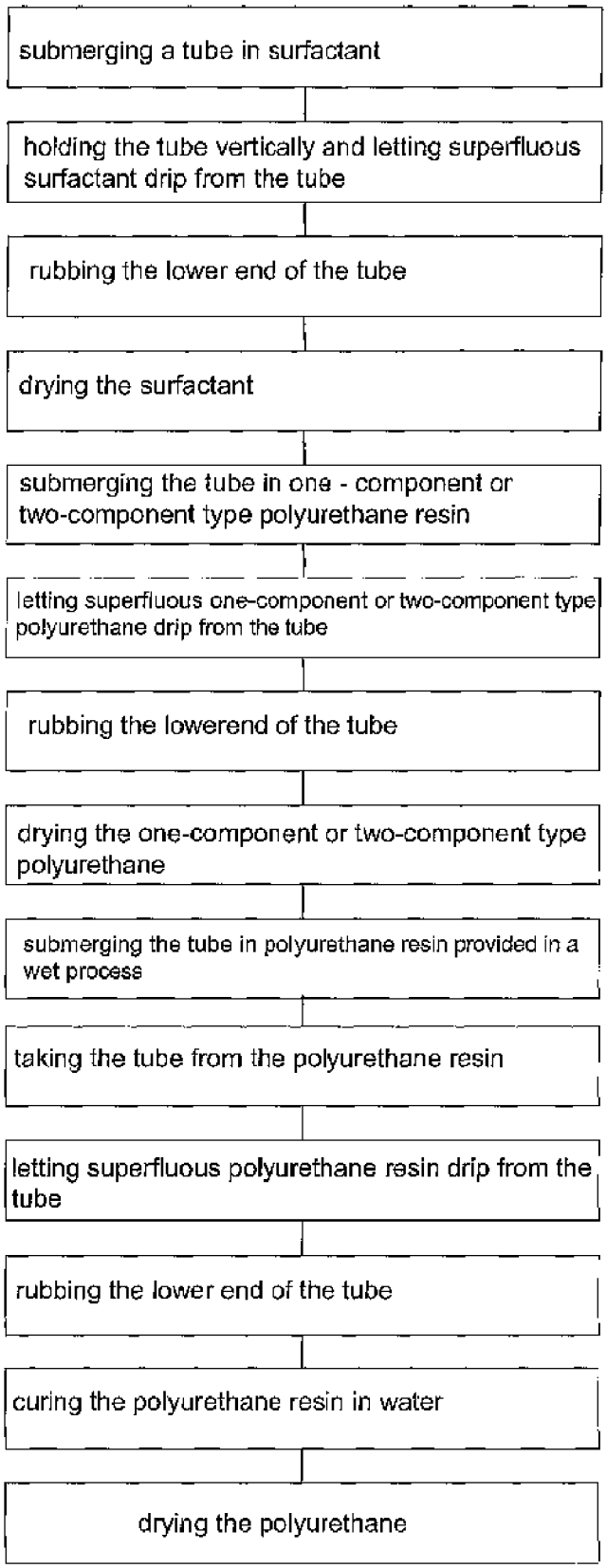
FIG. 6 is a flow chart of a method for making a grip from the rubber or thermoplastic tube shown in FIG. 1 according to a fifth embodiment of the present invention.

FIG. 6 is a flow chart of a method according to a fifth embodiment of the present invention. The fifth embodiment is similar to the fourth embodiment except including four steps between the step of drying the surfactant and the step of submerging the tube 1 in the pool of polyurethane resin. The additional steps are taken in order to improve the connection between the surfactant and the polyurethane resin provided in the wet process and to adjust the size of the grip Firstly, the tube 1 is submerged in a pool of one-component or two-component type polyurethane resin in a dry process.

Secondly, the tube 1 is moved from the pool of one-component or two-component type polyurethane resin and held vertically so that superfluous one-component or two-component polyurethane resin drips from the tube 1.

Thirdly, the thick closed end of the tube 1 is rubbed on a web. Thus, a small amount of the one-component or two-component type polyurethane resin dripping from the thick closed end of the tube 1 is wiped away.

Fourthly, the tube 1 coated with the one-component or two-component type polyurethane resin is dried.

Figure 7:
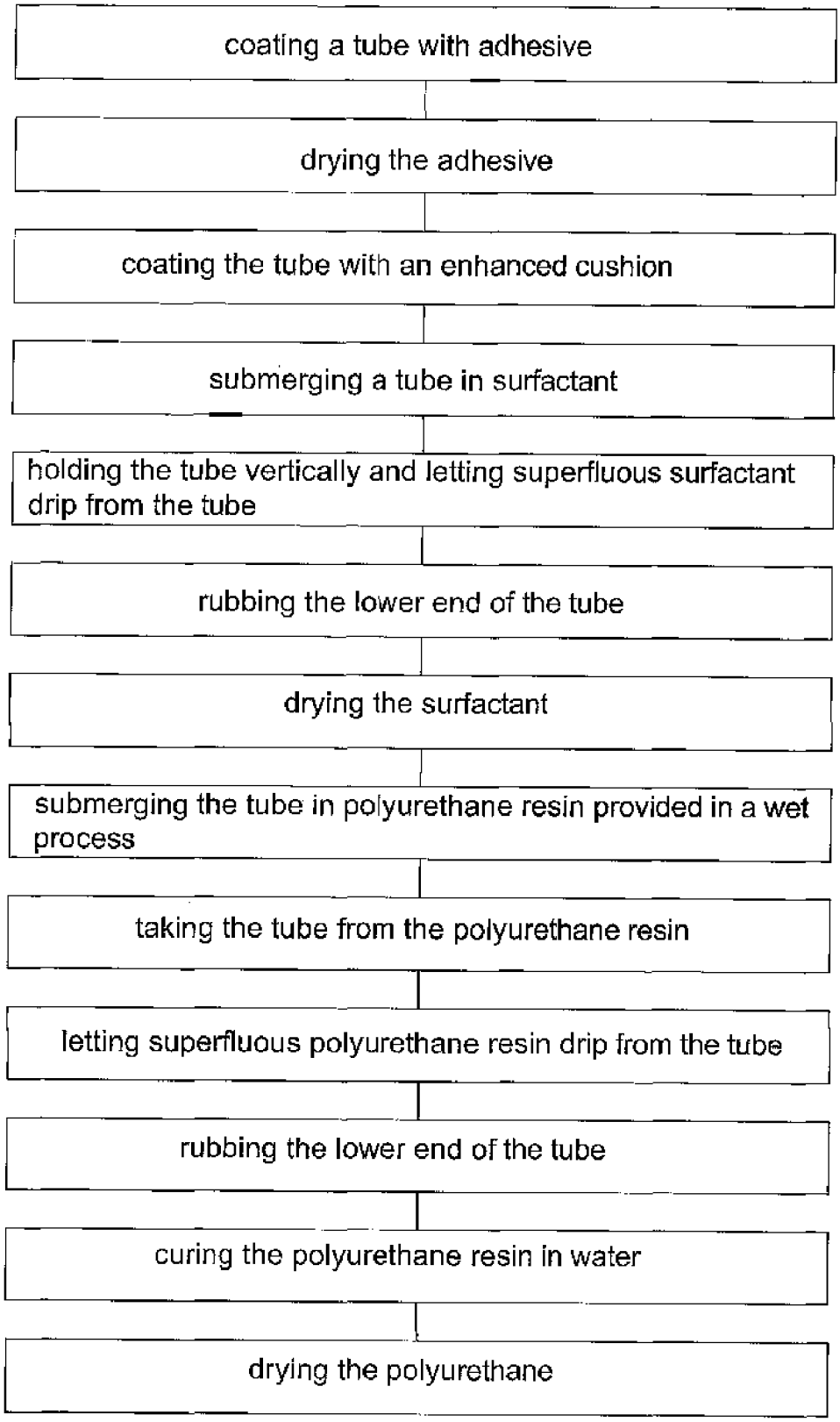
FIG. 7 is a flow chart of a method for making a grip from the rubber or thermoplastic tube shown in FIG. 1 according to a sixth embodiment of the present invention.

FIG. 7 is a flow chart of a method according to a sixth embodiment of the present invention. The sixth embodiment is similar to the first embodiment except including seven steps before the step of submerging the tube 1 in the pool of polyurethane resin. The additional steps are taken in order to provide a base cushion between the tube 1 and the cushion so as to enhance the cushioning effect.

Firstly, the tube 1 is coated with adhesive.

Secondly, the adhesive coated on the tube 1 is dried at a temperature of 20° C. to 90° C. for a time longer 30 seconds.

Thirdly, a base cushion is adhered to the tube 1 due to the adhesive provided between them. The base cushion may be a layer of felt or a foam material.

Fourthly, a large portion of the tube 1 is vertically submerged in a pool of surfactant, leaving a small portion of the tube 1 not submerged in the surfactant. The length of the small portion of the tube 1 is about 1 to 3 millimeters measured from the thin open end 11. The surfactant is provided in order to facilitate coating the tube 1 with polyurethane resin. The tube 1 is moved from the pool of surfactant soon after it is coated with the surfactant.

Fifthly, the tube 1 coated with the base cushion and the surfactant is held vertically. Thus, superfluous surfactant drips from the tube 1. The time of dripping is controlled to be longer than 30 seconds. The relative humidity is controlled to be less than 70% so that the tube 1 does not get wet and that the surfactant cures and becomes a film without flaws. Hence, the binding of the surfactant with the polyurethane resin is excellent.

Sixthly, the thick closed end of the tube 1 is rubbed on a web. Thus, a small amount of the surfactant dripping from the thick closed end of the tube 1 is wiped away. The relative humidity is controlled to be less than 70%.

Seventhly, the tube 1 coated with the base cushion and the surfactant is dried at a temperature of 20° C. to 90° C. for at least 2 minutes. Thus, the surfactant on the base cushion is dried.

The viscosity of the adhesive is required to be 500 to 4000 cps/25° C. The adhesive may be polyurethane resin or chloroprene rubber. The base cushion may be a layer of felt or a foam material. The foam material may be foam rubber or foam plastic such as foam polyurethane, foam polyethylene, foam polyvinyl chloride, foam butyronitrile, foam ethylene-vinyl acetate. Where the base cushion is a layer of felt, the surfactant includes polyurethane. Where the base cushion is a layer of foam polyethylene, foam butyronitrile or foam ethylene-vinyl acetate, the surfactant includes ethylene-vinyl acetate resin.

The present invention has been described through the detailed illustration of the embodiments. Those skilled in the art can derive variations from the embodiments without departing from the scope of the present invention. Therefore, the embodiments shall not limit the scope of the present invention defined in the claims.

What is claimed is:

1. A method for making a grip, the method comprising: providing a tube; and coating the tube with polyurethane resin in order to provide a cushion on the tube, wherein coating the tube with the polyurethane resin comprises submerging the tube in a pool of polyurethane resin; moving the coated tube from the pool of polyurethane resin; and letting superfluous polyurethane resin drip from the moved, coated tube after the submerging the tube in the pool of polyurethane resin, wherein letting the superfluous polyurethane resin drip from the tube comprises holding the tube vertically, and wherein coating the tube comprises coating the tube with the polyurethane resin in a wet process.

2. The method according to claim 1 comprising curing the polyurethane resin on the tube after coating the tube with the polyurethane resin in the wet process.

3. The method according to claim 2 comprising drying the polyurethane resin cured on the tube.

4. The method according to claim 2 wherein curing the polyurethane on the tube comprises submerging the tube in a pool of water.

5. The method according to claim 1 comprising wiping the lower end of the tube with a web formed of stainless steel after holding the tube vertically.

6. The method according to claim 1 further comprising coating the tube with surfactant before coating the tube with polyurethane resin.

7. A method for making a grip, the method comprising: providing a tube; coating the tube with polyurethane resin in order to provide a cushion on the tube; and providing a thermoplastic polyurethane film on the tube before coating the tube with the polyurethane resin.

8. The method according to claim 7 wherein coating the tube with the polyurethane resin comprises submerging the tube in a pool of polyurethane resin.

9. The method according to claim 8 comprising letting superfluous polyurethane resin drip from the tube after submerging the tube in the pool of polyurethane resin.

10. A method for making a grip, the method comprising: providing a tube made of rubber; coating the tube with polyurethane resin in order to provide a cushion on the tube; and coating the tube with surfactant in the form of a halogenating agent before coating the tube with the polyurethane resin.

11. The method according to claim 10 wherein coating the tube with the surfactant comprises painting the tube with the surfactant.

12. The method according to claim 11 comprising drying the tube after painting the tube with the surfactant.

13. The method according to claim 10 wherein coating the tube with the surfactant comprises spraying the tube with the surfactant.

14. The method according to claim 13 comprising drying the tube after spraying the tube with the surfactant.

15. The method according to claim 10 wherein coating the tube with the surfactant comprises submerging the tube in a pool of surfactant.

16. The method according to claim 15 comprising letting superfluous surfactant drip from the tube after submerging the tube in the pool of surfactant.

17. The method according to claim 16 wherein letting the superfluous surfactant drip from the tube comprises holding the tube vertically.

18. The method according to claim 17 comprising wiping the lower end of the tube with a web formed of stainless steel after holding the tube vertically.

19. The method according to claim 18 comprising drying the tube after wiping the lower end of the tube.

20. The method according to claim 10 wherein coating the tube with the polyurethane resin comprises coating the tube with the polyurethane resin in a wet process.

21. The method according to claim 10 wherein coating the tube with surfactant comprises coating the tube with trichloroisocyanuric acid.

22. A method for making a grip, the method comprising: providing a tube; coating the tube with polyurethane resin in order to provide a cushion member on the tube, wherein coating the tube with the polyurethane resin comprises submerging the tube in a pool of polyurethane resin; moving the coated tube from the pool of polyurethane resin; and letting superfluous polyurethane resin drip from the moved, coated tube after the submerging the tube in the cool of polyurethane resin, wherein letting the superfluous polyurethane resin drip from the tube comprises holding the tube vertically, and wherein coating the tube comprises coating the tube with the polyurethane resin in a wet process; and providing a cushion on the tube before providing the cushion member by coating the tube with the polyurethane resin.

23. The method according to claim 22 wherein providing the cushion on the tube comprises: coating the tube with adhesive; and adhering the cushion to the tube with the adhesive.

24. The method according to claim 23 wherein the cushion is a layer of felt material.

25. The method according to claim 23 wherein the cushion is a layer of a foam material.

26. The method according to claim 22 further comprising: providing surfactant on the tube provided with the cushion before providing the cushion member by coating the tube with the polyurethane resin; and wiping a lower end of the tube held vertically to let the superfluous resin to drip from the tube.

27. A method for making a grip, the method comprising providing a tube; coating the tube with polyurethane resin in order to provide a cushion on the tube, wherein coating the tube with the polyurethane resin comprises coating the tube with the polyurethane resin in a wet process; coating the tube with surfactant before coating the tube with the polyurethane resin; and coating the tube with polyurethane resin in a dry process between coating the tube with the surfactant and coating the tube with the polyurethane resin in the wet process.

28. The method according to claim 27 wherein coating the tube with the polyurethane resin in the dry process comprises submerging the tube in a pool of polyurethane resin in a dry process.

29. The method according to claim 28 comprising letting superfluous polyurethane resin drip from the tube after submerging the tube in the pool of polyurethane resin in the dry process.

30. The method according to claim 29 wherein letting the superfluous polyurethane resin drip from the tube comprises holding the tube vertically.

31. The method according to claim 30 comprising wiping the lower end of the tube with a web after holding the tube vertically.

32. The method according to claim 31 comprising drying the polyurethane resin coated on the tube after wiping the lower end of the tube with the web.

* * * * *